United States Patent [19]

Uytterhoeven et al.

[11] Patent Number: 4,564,574

[45] Date of Patent: Jan. 14, 1986

[54] LIQUID DEVELOPER FOR DEVELOPMENT OF ELECTROSTATIC IMAGES

[75] Inventors: Herman J. Uytterhoeven, Bonheiden; Walter F. De Winter, 's-Gravenwezel; August M. Marien, Oevel, all of Belgium

[73] Assignee: Agfa-Gevaert, N.V., Mortsel, Belgium

[21] Appl. No.: 632,059

[22] Filed: Jul. 18, 1984

[30] Foreign Application Priority Data

Aug. 5, 1983 [EP] European Pat. Off. ..... 83201162.1

[51] Int. Cl.[4] ..... G03G 9/12

[52] U.S. Cl. ..... 430/115; 430/904

[58] Field of Search ..... 430/112, 113, 114, 115, 430/904

[56] References Cited

U.S. PATENT DOCUMENTS 4,404,271 9/1983 Kawagishi ..... 430/110

*Primary Examiner*—John D. Welsh

*Attorney, Agent, or Firm*—A. W. Breiner

[57] ABSTRACT

A liquid electrophoretic developer composition suitable for rendering visible electrostatically charged areas, which composition contains in an electrically insulating non-polar carrier liquid having a volume resistivity of at least $10^9$ ohm.cm and a dielectric constant less than 3, dispersed coloring matter acting as toner particles and at least one polymer comprising cationic groups neutralized with counter anions, the said cationic groups being positively charged groups of metal ion containing coordination compounds.

14 Claims, No Drawings

LIQUID DEVELOPER FOR DEVELOPMENT OF ELECTROSTATIC IMAGES

The present invention relates to a liquid developer for development of electrostatic images.

Known electrophotographic processes comprise the steps of electrostatically charging in the dark a photoconductive surface, image-wise exposing said surface whereby the irradiated areas become discharged in accordance with the intensity of radiation thus forming a latent electrostatic image, and developing the material to form a visible image by depositing on the image a finely divided electroscopic material known as "toner". The toner particles consist of or include colouring substances, e.g. carbon black. The thus developed image may be fixed to the surface carrying the electrostatic charge image or transferred to another surface and fixed thereon.

A process of developing an electrostatic image by use of an electrically insulating liquid developer, which contains dispersed particles of colouring substance called toner particles, that render the charge pattern visible through the phenomenon of electrophoresis, has been described already e.g. in the U.S. Pat. No. 2,907,674 of Kenneth Archibald Metcalfe and Robert John Wright issued Oct. 6, 1959.

In electrophoretic development a distinction is made between developers having dispersed toner particles which possess a positive charge and those which possess a negative charge. The charge value and the polarity of the toner particles are influenced by means of one or more so-called charge control agents.

In order to fix the toner particles at the places where they are deposited electrostatically, each particle comprises a thermoplastic resin coating, which may also play the role of dispersing agent and may serve also as charge control agent when containing ionic or ionizable groups.

Charging of the dispersed particles may proceed according to one method by a chemical compound that provides a charge from a chemical dissociation reaction on the toner particle surface and the introduction of a counter-ion in the electrically insulating carrier liquid.

For example, according to U.S. Pat. No. 3,977,983 a liquid for use in the development of an electrostatic charge pattern is provided, which liquid developer contains as charge-controlling agent a copolymer having amino groups converted into quaternary ammonium salt groups or quaternary ammonium hydroxide. Said copolymers render the toner particles negatively charged.

These particular copolymers are described as being well-soluble in the carrier liquid and imparting a sufficient charge to the toner particles without lowering the electric resistance of the carrier liquid when dissolved therein.

It is an object of the present invention to provide an electrophoretic liquid developer containing positively charged toner particles with stable particle charge, i.e. a particle charge that is practically invariable with time.

Other objects and advantages of the present invention will be clear from the further description.

According to the present invention a liquid developer composition is provided that is suitable for rendering visible electrostatically charged areas, which composition contains in an electrically insulating non-polar carrier liquid having a volume resistivity of at least $10^9$ ohm.cm and a dielectric constant less than 3, dispersed colouring matter acting as toner particles and at least one polymer comprising cationic groups neutralized with counter anions, characterized in that said cationic groups are positively charged groups of metal ion containing coordination compounds.

The metal ion (A) is the central or nuclear ion, and all other atoms or groups which are directly attached to (A) are known as coordinating atoms or groups (B). These atoms or groups (B) are called ligands.

A chemical system containing more than one coordinating atom or group is called a multidentate coordination system the number of coordinating atoms or groups being called in increasing order: unidentate, bidentate, tridentate, tetradentate, pentadentate, sexadentate, etc.

The whole assembly of one or more central metal ions with their attached ligands is called a complex ion.

A chelating agent is by definition an organic or inorganic molecule or ion (called a ligand) that coordinates a metal ion in more than one position, i.e. through two or more electron donor groups in the ligand. The development of chelating agents has occurred primarily in the field of organic ligands, because it has been possible to synthesize organic ligands with many functional donor groups in different steric arrangements; thus high stability. The most common and most widely used chelating agents are those that coordinate metal ions through oxygen or nitrogen donor atoms, or a combination of the two.

In general, metal ions may be classified into several groups, depending on their coordination tendencies. The more basic metal ions, such as the alkaline earth metals, rare earth metals, and positive actinide ions have greater affinity for oxygen than for nitrogen (ref. Kirk-Othmer-Encyclopedia of Chemical Technology, second ed. Vol. 6 (1965) p. 1–7).

The use of positively charged groups of coordination compounds as cationic groups in a polymer whether it be a homopolymer, copolymer (statistical), block copolymer or graft copolymer makes that the anion associated therewith is rather loosely bound thereto since the effective radius of the positively charged coordination group through its ligand(s) is rather large, so that only a weak electric field strength is present at the periphery of the cation.

Hereby the dissociaton of the ion pair composed of said cationic group and anion increases. By the adsorption of the positively charged polymer chains the toner particles obtain a positive charge with respect to the bulk of the developer liquid containing the anions.

Since the carrier liquids used in electrophoretic development have a small dielectric constant (less than 3) the dissociation of the ion-pairs therein by mere polarisation does not suffice and therefore a large inter-ion distance by sterical hindrance is applied here to make possible ion-pair breaking by normal thermal energy in the carrier liquid.

Examples of useful positively charged groups of coordination compounds are:

(1) bidentate groups with central $Me^{2+}$, $Me^{3+}$ or $Me^{4+}$ ion (Me=metal), (2) tridentate groups with central $Me^{2+}$, $Me^{3+}$ or $Me^{4+}$ ion, (3) glyme-groups (polyglycol dimethyl ether groups) with central metal ion, (4) crown-ether groups (macrocyclic polyether groups) with central metal ion, and (5) cryptate groups (macrobicyclic polyether groups) with central metal ion.

Examples of such groups on a polymer chain are:

for bidentate with central $Me^{2+}$, $Me^{3+}$ or $Me^{4+}$ ion:

polymeric Cu(II)-acetyl-acetonate chelate (see ref. 4) as represented by the formula:

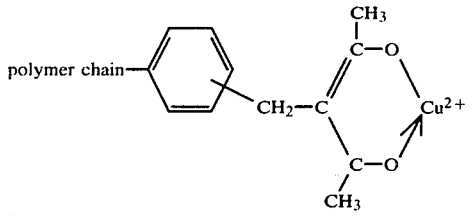

for tridentates with central $Me^{2+}$, $Me^{3+}$ or $Me^{4+}$ ion:

polymeric 1,3-bis(2'-pyridylimino)isoindoline chelate of Cu(II):

as represented by the formula:

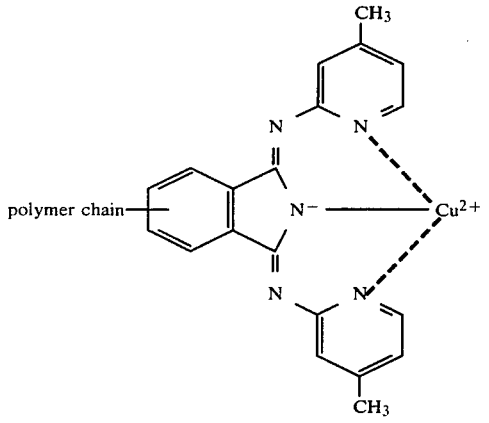

polymeric Al(III) iminodiacetic acid chelate as represented by the formula:

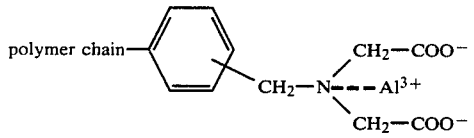

for glymes complexing $Na^+$ or $K^+$:

polymeric pentaethylene glycol dimethylether also called "glyme-6" as represented by the formula:

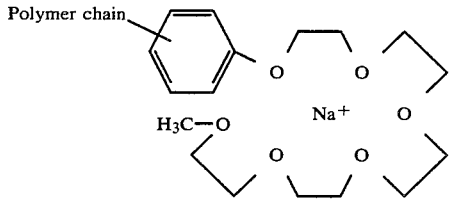

for crown-ethers complexing $Na^+$ or $K^+$:

polymeric benzo-18-crown-6 (see ref. 8) as represented by the formula:

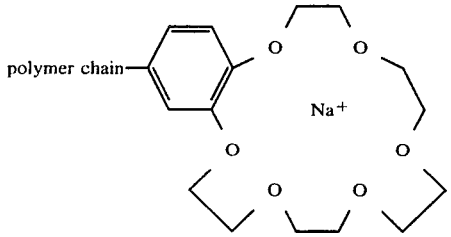

for cryptates complexing $Na^+$ or $K^+$:

polymerized 18-vinyl-5,6-benzo-4,7,13,16,21,24-hexaoxa-1,10-diazabicyclo[8.8.8]hexa-cos-2-ene (see ref. 20), the monomer being represented by the following structural formula:

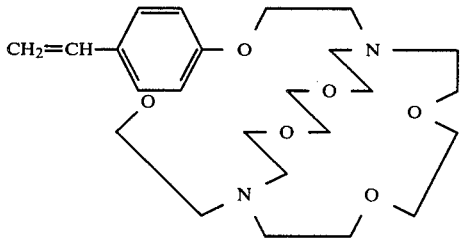

complexing $Na^+$

The implantation of the coordination compound groups in or on a polymer chain may proceed by techniques known in the art according to one of the following references:

(1) Chemistry and Industry, Apr. 18, 1981, p. 291-292-"Polymeric Chelating Ligands Derived from 1,3-bis(2'-pyridylimino)isoindolines"

(2) Journal of Applied Polymer Science, Vol. 27, 4161-4169 (1982)-"Chelating Resin: Pyridine Derivatives Attached to Poly(styrene)".

(3) Journal of Applied Polymer Science, Vol. 26, 1475-1484 (1981) "Reaction with Metal Ions of Chloromethylated Polystyrene Resin Containing Dithiocarbamate Group".

(4) Journal of Polymer Science, Polymer Edition, Vol. 20, 2575-2602 (1982)-"Metal-Acetylacetonate Chelate Cross-linked Gels".

(5) Die Angewandte Makromolekulare Chemie, 107 (1982) 33-42 (Nr. 1675) including references to the preparation of some Bisphenolic Chelate Polymers.

(6) J.Org.Chem., Vol. 44, no. 7 (1979) 1099-1103 "Polymer bound Acyclic Poly(oxyethylene) Derivatives".

(7) S. Kopolow, T. E. Hogen, J. Smid, Macromolecules 6, 113 (1973).

(8) Kimura, T. Maeda, T. Shono, Polym.Bull. 1, 403 (1979).

(9) Jun-ichi Anazi, Yoko Sakata, Akihito Ueno, Tetsuo Osa-Macromel.Chem., Rapid Commun. 3, 399-403 (1982) "Crown Ether Modified Polyethylene-imine".

(10) Reiichi Kimuri, Takumi Maeda, Toshiyuki Shono-Makromol.Chem. 182, 1579-1586 (1981).

(11) Keiichi Kimura, Hiroshi Tamura, Takumi Maeda and Toshiyuki Shono Polymer Bulletin 1, 403-407 (1979) "Tactic Poly(crown ether)s with Pendant Benzocrown Ethers".

(12) A. J. Varma, T. Majewicz and J. Smid-Journal of Polymeric Science: Polymer Chemistry Edition, Vol.

17, 1573–1581 (1979)-"Polysalt Complexes of Poly(-vinylbenzo-18-Crown-6) and Poly(crown Acrylate)s with Polyanions.

(13) Georg Manecke, Andreas Krämer-Makromol. Chem. 182, 3017–3030 (1981)-"Über polymere Koronanden auf der Basis von 18-Krone-6 enthaltenden Vinylmonomeren.

(14) T. C. Kuan, C. L. Chiou and S. J. Wang Polymer Bulletin 9, 216–222 (1983)-Facile Synthesis of a Monomer 4'-Vinyldibenzo-14-Crown-4

(15) Von Steven L. Regen-Angew.Chem. 91, 464–472 (1979).

(16) Abraham Warshawsky, Rami Kalir, Abraham Deshe, Hedva Berkovitz and Avaraham Patchornik-Journal of the American Society/101:15/July 18, (1979) 4249–4258-Polymeric Pseudocrown Ethers.

(17) Yves Frére, Philippe Gramain-Makromol. Chem. 183, 2163–2172 (1982)-"Preparation and Application of Ion Exchangers with Azacrown-ether and Cryptands to Alkali and Alkaline-earth Cation Separation".

(18) E. Blasius et al, Z.Anal.Chem. 284, 337–360 (1977) "Herstellung, Charakterisierung und Anwendung complexbildender Austaucher mit Kronenverbindungen oder Kryptanden als Ankergruppen".

(19) Georg Manecke, Peter Reuter, Makromol. Chem., 182, 1973–1984 (1981)-Polymere Kryptanden, 1.

(20) Philippe Gramain, Yves Frére, Makromol.Chem., Rapud Commun. 2, 161–165 (1981) "Synthesis and Ion Binding Properties of the Polycryptate Poly(4,7,13, 76-tetraoxa-1,10,21-24-tetraazabicyclo [8.8.8]hexacos-21,24-ylene-2,7-dihydroxy-octamethylene).

For illustrative purposes detailed preparations of polymers comprising positively charged groups of metal ion containing coordination compounds is given hereinafter.

Preparation 1

Step 1

Synthesis of copoly(isobutyl methacrylate-stearyl methacrylate-N-vinylbenzylimino diacetic acid) having the following structural formula:

(copolymer A)

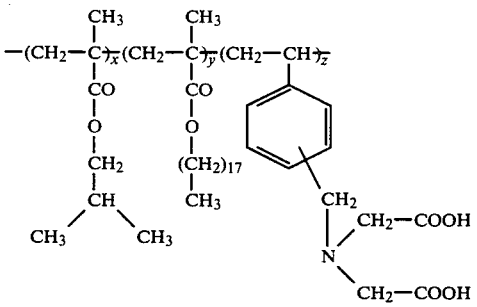

x=75% by weight
y=20% by weight
z=5% by weight

The copolymerization was carried out in a three-necked reaction flask of 1 liter provided with stirrer, nitrogen inlet, thermometer and reflux-cooler, using the following ingredients:

isobutyl methacrylate: 75 g
stearyl methacrylate: 20 g
N-vinylbenzylimino diacetic acid: 5 g
azo-bis-isobutyronitrile: 0.2 g
dimethylformamide (distilled): 400 ml The copolymerization proceeded for 24 h at a temperature of 70° C. under a nitrogen atmosphere.

The reaction mixture was cooled whereupon the copolymer was separated by precipitation in methanol. The slightly sticky precipitate was dissolved in acetone and precipitation was repeated with methanol. After having been separated the copolymer was dried under reduced pressure. Yield: 60 g. The HOOC-content was 0.402 meq/g corresponding with 5% by weight.

The synthesis of N-vinylbenzyliminodiacetic acid is described in J.A.C.S. 81, 377 (1959).

Step 2

Synthesis of copolymer B being the reaction product of aluminiumhydroxy abietate with copolymer A.

To a solution of 10 g of copolymer A dissolved in 50 ml of tetrahydrofuran a solution of 1.3 g of aluminiumhydroxy abietate in 50 ml of tetrahydrofuran was dropwise added. The reaction mixture was then stirred for 1 h at room temperature. Copolymer B was separated by precipitation in water. The slightly sticky copolymer was transformed into a flaky precipitate by washing with methanol and separated by suction filtering. After drying under reduced pressure 7.5 g of copolymer B were obtained.

The synthesis of aluminiumhydroxy abietate is described in "DAS Papier" II 21/22, November 1957, p. 503.

Preparation 2

Step 1

Synthesis of copoly(isobutyl methacrylate-stearyl methacrylate-vinylbenzyl chloride) having the following structural formula:

(copolymer C)

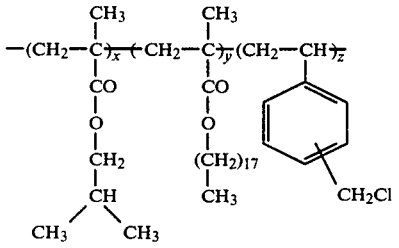

x=60% by weight
y=20% by weight
z=20% by weight (the vinylbenzyl chloride is 60% by weight meta-derivative and 40% by weight para-derivative).

Copolymer C was prepared by reacting for 24 h the constituting monomers in n-butanone at 80° C. using benzoyl peroxide as initiator.

The copolymer was separated by precipitation in methanol and was dried under reduced pressure at room temperature.

Chlorine content (calculated): 1.311 meq/g. (found): 1.311 meq/g.

Step 2

Synthesis of copolymer D having the following structural formula:

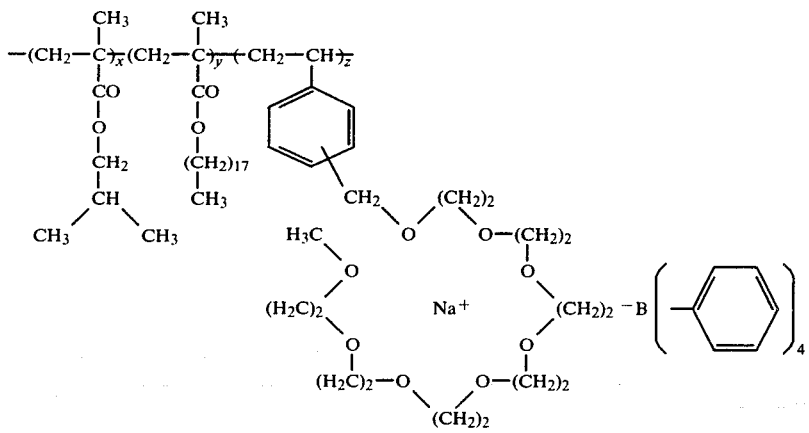

x=60% by weight
y=20% by weight
z=20% by weight

To a solution of 4.588 g of polyethyleneglycol monomethylether (average molecular weight 335 to 365 and containing 13.11 meq/g of free HO-groups) in 50 ml of anhydrous dioxane were gradually added whilst stirring 0.5725 g of sodium hydride (Na—H) dispersion in mineral oil containing 13.11 milliequivalent (meq.) of the hydride. The foaming of the reaction mixture was kept under control by the rate of Na—H introduction. The reaction mixture was then further stirred for 1 h at room temperature and whereupon a solution of 10 g of said copolymer C in 50 ml of dioxane were added dropwise. After a period of 24 h with continued stirring the reaction product was added dropwise whilst stirring to a solution of 4.483 g of sodium tetraphenyl borate (13.11 meq) in 150 ml of dioxan. During a further period of stirring (1 h) the copolymer precipitated. The supernatant liquid was discarded and the sticky residue was dried under reduced pressure. The dried mass was pulverized. Yield of copolymer D: 15 g of yellow powder.

The positively charged groups of the coordination compound may be used in combination with any neutralizing anion. For example halide ions e.g. iodide, monomethylsulphate and p-toluene sulphonate ions.

The use of anions with a relatively large effective radius in combination with said positively charged coordination compound groups further improves the dissociation of the corresponding ion pairs in apolar liquid medium. Such anions are described in the published European Patent Application No. 0,114,419.

These anions belong to the groups I, II, III, IV, V and VI.

Group I

Polyatomic anions wherein the negative charge is localized on an atom or atomic group which is sterically embraced or surrounded by at least two non-ionic hydrocarbon substituents each contaning at least 4 carbon atoms.

Examples of such anions are:

sterically hindered phenolates and aromatic carboxylates e.g. benzoates having as substituents $C_4$–$C_{20}$ alkyl groups, aralkyl groups, cycloalkyl groups or aryl groups, preferably in ortho-position to embrace the $—O^-$ or $—COO^-$ group or abietates;

tetrahydrocarbon-substituted boride anions according to the following general formula:

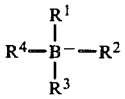

wherein:

each of $R^1$,$R^2$,$R^3$ and $R^4$ (same or different) represents a $C_4$–$C_{20}$ alkyl or alkenyl group, a cycloalkyl group, an aralkyl group e.g. benzyl or an aryl group, e.g. a phenyl or a tolyl group.

The tetraphenylboride anion in alkali metal salts has been described e.g. in The Journal of Physical Chemistry, Vol. 69, No. 2, February 1965 p. 608–611.

Group II

Polyatomic anions which contain a negatively charged central atom embraced by at least 4 oxygen atoms e.g. $ClO_4^-$ and $ReO_4^-$.

Polyatomic anions containing a negatively charged central borine, arsenic, aluminium, silicon, phosphorus, tin, antimony, tantalum or bismuth atom surrounded by at least 4 halogen e.g. fluorine atoms.

Examples of the last mentioned anions are: ($PF_6^-$), ($AsF_6^-$) and ($TaF_6^-$).

($PF_6^-$) and ($TaF_6^-$) anions are described in Scientific American, July 1982 p. 59 as negatively charged ions in organic superconducting crystals.

Group III

Polyatomic anions wherein the negative charge is delocalized over an aromatic conjugated system of alternating single and double bonds by the presence thereon of one or more electron-withdrawing (electronegative) substituents.

Examples of such anions correspond to the following general formula:

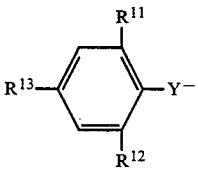

wherein:

$Y^-$ represents a $—O^-$ or $—S^-$ group, and each of $R^{11}$, $R^{12}$ and $R^{13}$ (the same or different) is an electron-withdrawing substituent i.e. $—NO_2$, halogen, —CN, $—CF_3$, —CHO and the like.

A survey of "electron-withdrawing substituents" has been given by Peter Sykes in "A Guidebook to Mechanism in Organic Chemistry"-Longmans, London-5th impression (1963) p. 107. At p. 18 of the same book is said: "the nitro group lowers the density of negative charge over the nucleus, as compared with benzene itself; it is an electron-withdrawing group in contrast to the negatively charged oxygen atom in the phenoxide ion, which is an electron-donating group".

Group IV

Anions of cyanocarbon acids

These acids (ref. W. J. Middleton and co-workers, J.Am.Chem.Soc. 80, 2795 (1962) are organic molecules that contain a plurality of cyano groups and are readily ionized to hydrogen ions and resonance-stabilized anions i.e. anions with delocalized negative charge. Examples of the acids are given by Kirk-Othmer "Encyclopedia of Chemical Technology" 3th ed. Vol. 7 (1979)-John Wiley & Sons, New York p. 364, e.g. cyanoform or methane-tricarbonitrile and 1,1,2,3,3-pentacyanopropane.

Group V

Anions of anionic dyes, having in the anion part a delocalized negative charge. Such dyes are e.g.: phthalocyanine dyes, e.g.:

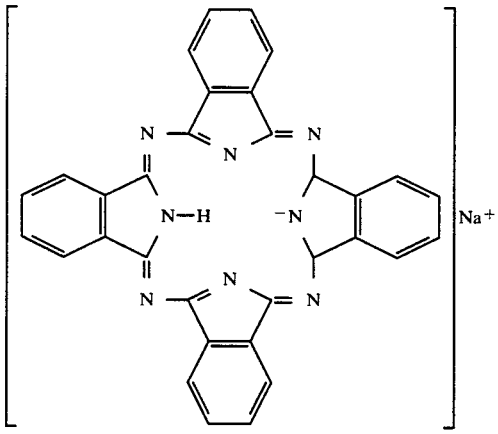

oxonol dyes, i.e. acid dyes linking two ketomethylene nulcei by a methine group or a methine chain e.g.:

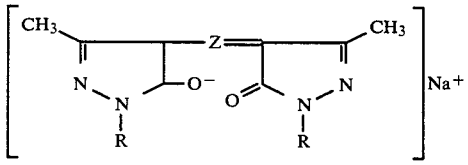

wherein:

z is a methine group or a methine chain, and

R is an aryl group e.g. phenyl.

phenolphthaleine dyes, e.g.:

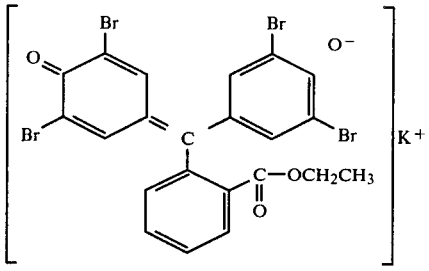

(potassium tetrabromophenolphthaleine ethyl ester)

Group VI

Radical anions containing an unpaired electron and a negative charge on different atoms. For a monograph relating to this type of ions see Kaiser and Kevan "Radical Ions"-Interscience Publishers, New York 1968.

Radical anions for use according to the invention are:

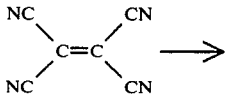

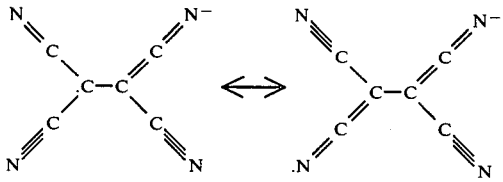

tetracyanoethylene=TCNE

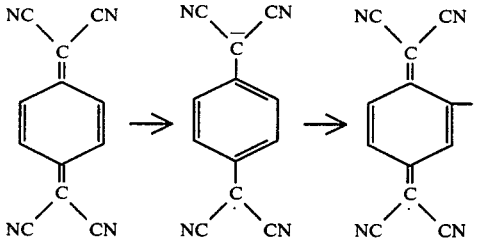

7,7,8,8-tetracyano-p-quinodimethane=TCNQ

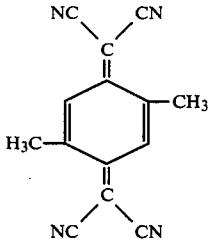

2,5-dimethyl-7,7,8,8-tetracyano-p-quinodimethane=DMTCNQ

Stable anion radicals other than TCNQ anion radicals are easily prepared from aromatic hydrocarbons e.g. 9,10-diphenylanthracene, by electrochemical reduction in acetonitrile or dimethylformamide-containing electrolytes such as tetrabutylammonium perchlorate (ref. Kirk-Othmer in the already mentioned "Encyclopedia of Chemical Technology" Vol. 5 (1979) p. 430.

In the polymers for use according to the present invention the recurring units including said positively charged groups of coordination compounds may be combined with recurring units of non-ionic hydrophobic solvatizing monomers.

Optionally used non-ionic hydrophobic solvatizing monomers are listed hereinafter in List I.

List I alkylstyrenes having from 3 to 10 carbon atoms in the alkyl group,
alkoxystyrenes having from 3 to 10 carbon atoms in the alkyl group,
alkyl acrylates and methacrylates having from 8 to 22 carbon atoms in the alkyl group,
vinyl alkyl ethers having from 8 to 22 carbon atoms in the alkyl group,
vinyl esters of alkanoic acids having from 6 to 22 carbon atoms in the alkyl group.

Preferred non-ionic hydrophobic solvatizing monomers are: lauryl acrylate, lauryl methacrylate, hexadecyl methacrylate, octadecyl methacrylate, vinyl laurate, vinyl palmitate, vinyl stearate, vinyl eicosate and vinyl docosate.

The non-ionic hydrophobic solvatizing monomer units may be used in admixture with substantially non-solvatizing non-ionic monomer units. Examples of such non-ionic non-solvatizing monomers are enumerated in List II.

List II (a) $\alpha,\beta$-ethylenically unsaturated carboxylic acid alkyl esters with $C_1$–$C_4$ alkyl group,
(b) styrene, methylstyrene, methoxystyrene and halogenated styrene,
(c) vinyl alkyl ethers having from 1 to 4 carbon atoms in the alkyl group, and
(d) vinyl esters of alkanoic acids having from 1 to about 4 carbon atoms in the alkyl groups and mixtures thereof.

Examples of non-ionic "non-solvatizing" monomers increasing the adsoption to the pigment particles are: styrene, vinyltoluene, ethyl acrylate, propyl methacrylate, isobutyl methacrylate, vinyl acetate, vinyl propionate, vinyl butyrate and mixtures thereof.

A further improved dispersion stability can be obtained by incorporating in the toner dispersion non-ionic copolymers of the type disclosed in the United Kingdom Patent Specification No. 1,571,401 and block-copolymers claimed for that purpose in European Patent Application No. 83 200 852.8 filed June 10, 1983 by Agfa-Gevaert N.V.

The insulating liquid used as carrier liquid in the present liquid developer may be any kind of non-polar, fat-dissolving solvent. Said liquid is preferably a hydrocarbon solvent e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons having a boiling range preferably between 150° C. and 220° C. such as the ISOPARS G, H, K and L (trade marks) of Exxon and SHELLSOL T (trade mark) of the Shell Oil Company.

The colouring substance used in the toner particles may be any inorganic pigment (said term including carbon) or solid organic dyestuff pigment commonly employed in liquid electrostatic toner compositions. Thus, for example, use can be made of carbon black and analogous forms thereof e.g. lamp black, channel black and furnace black e.g. RUSS PRINTEX 140 GE-PERLT (trade-name of DEGUSSA-Frankfurt/M, W. Germany).

Typical solid organic dyestuffs are so-called pigment dyes, which include phthalocyanine dyes, e.g. copper phthalocyanines, metal-free phthalocyanine, azo dyes and metal complexes of azo dyes.

The following dyes in pigment form are given for illustration purposes only: FANALROSA B Supra Pulver (trade-name of Badische Anilin- & Soda-Fabrik AG, Ludwigshafen, Western Germany), HELIOGEN-BLAU LG (trade-name of BASF for a metal-free phthalocyanine blue pigment), MONASTRAL BLUE (a copper phthalocyanine pigment, C.I. 74,160). HELIOGENBLAU B Pulver (trade-name of BASF), HELIOECHTBLAU HG (trade-name of Bayer AG, Leverkusen, Western Germany, for a copper phthalocyanine C.I. 74,160), BRILLIANT CARMINE 6B (C.I. 18,850) and VIOLET FANAL R (trade-name of BASF, C.I. 42,535).

Typical inorganic pigments include black iron(III) oxide and mixed copper(II) oxide/chromium(III) oxide/iron(III) oxide powder, milori blue, ultramarine cobalt blue and barium permanganate. Further are mentioned the pigments described in the French Patent Specification Nos. 1,394,061 filed Dec. 23, 1963 by Kodak Co., and 1,439,323 filed Apr. 24, 1965 by Harris Int.Corp.

Preferred carbon black pigments are marketed by DEGUSSA under the trade name PRINTEX. PRINTEX 140 and PRINTEX G are preferably used in the developer composition of the present invention. The characteristics of said carbon blacks are listed in the following Table 2.

TABLE 2

| | PRINTEX 140 | PRINTEX G |
|---|---|---|
| origin | channel black | furnace black |
| density | 1.8 g. $cm^{-3}$ | 1.8 g. $cm^{-3}$ |
| grain size before entering the developer | 29 nm | 51 nm |
| oil number (g of linseed oil adsorbed by 100 g of pigment) | 360 | 250 |
| specific surface (sq. m per g) | 96 | 31 |
| volatile material % by weight | 6 | 2 |
| pH | 5 | 8 |
| colour | brown-black | blue-black |

As colour corrector for the PRINTEX pigments preferably minor amounts of copper phthalocyanine are used, e.g. from 1 to 20 parts by weight with respect to the carbon black.

For a given charge density of the charge-carrying surface the maximum development density attainable with toner particles of a given size is determined by the charge/toner particle mass ratio, which is determined substantially by the amount and/or type of polymer employed.

A liquid developer composition according to the present invention can be prepared by using dispersing and mixing techniques well known in the art. It is conventional to prepare by means of suitable mixers e.g. a 3-roll mill, ball mill, colloid mills, high speed stirrers, a concentrate of e.g. 5 to 80% by weight of the solid materials selected for the composition in the insulating carrier liquid and subsequently to add further insulating carrier liquid to provide the liquid toner composition ready for use in the electrostatic reproduction process. It is generally suitable for a ready-for-use electrophoretic liquid developer to incorporate the toner in an amount between 0.3 g and 20 g per liter, preferably between 2 g and 10 g per liter.

The (co)polymer(s) used in the present developer liquid can be applied as a pre-coating to the pigment particles prior to their introduction in the carrier liquid or can be introduced as a separate ingredient in the liquid and allowed to become adsorbed onto the pigment particles.

The electrophoretic development may be carried out using any known electrophoretic development technique or device. The field of the image to be developed may be influenced by the use of a development electrode. The use of a development electrode is of particular value in the development of continuous tone images. When no development electrode is used, the developed image may exhibit exaggerated density gradients, which may be of interest e.g. in certain medical X-ray images for diagnostic purposes.

The following examples illustrate the present invention.

EXAMPLE 1

1 g of copolymer B prepared according to preparation 1 was first dissolved in 50 ml of tetrahydrofuran and 4 g of PRINTEX G (trade name) carbon black pigment was dispersed therein.

After dispersion the solvent was evaporated leaving the copolymer coated onto the carbon black particles.

The copolymer-coated carbon black was then redispersed in 50 ml of isododecane by ball-milling for 15 h.

The obtained toner developer contained positively charged toner particles which was proven by the fact that the zeta potential ($\xi$) measured in a micro-electrophoresis cell built according to the description given by Van der Minne and Hermanie, J.Colloid Sci. 7, 600 (1952) had a positive sign ($\xi = +33$ mV).

By definition the zeta potential is the potential gradient across the diffuse double layer, which is the region between the rigid layer attached to the toner particle and the bulk of the solution (ref. C. P. Priesing-"A Theory of Coagulation useful for Design"-Ind. Eng. Chem. Vol. 54, No. 8, August 1962, p. 40–41). The zeta potential ($\xi$) is related to Q, the charge of the particle, by the following formula:

$$\xi = \frac{Q}{\cdot r}\left(\frac{1}{1 + K \cdot r}\right)$$

wherein:

is the dielectric constant of the liquid, r is the radius of the particle, and

1/K is called the Debye-length; it has the dimensions of a length and is taken as a measure of the thickness of the double layer (ref. R. M. Schaffert-Electrophotography 2nd revised ed.-The Focal Press, London and New York (1975) 562–563).

The charge sign of the toner particles and their charge stability were determined by a test proceeding as follows:

"In an electrophoresis cell having two planar electrodes each with a surface of 20 $cm^2$ spaced at a distance of 0.15 cm is filled with the above toner developer of which 4 ml were diluted with 1 liter of isododecane. The electric current (I) flowing between the two electrodes at a voltage puls of 500 V for 0.5 s is measured."

The current (I) is the result of a charge (Q) transport due to the inherent conductivity of the liquid without toner and the electrophoretic toner particle displacement towards one of the electrodes and the movement of its counter ions towards the other electrode. The toner-deposition (blackening) of the negative electrode (cathode) proves that the toner particles are positively charged. The $Q_T$ value is the current I in amperes integrated over the period (t) of 0.5 s and is a measure for the charge on the toner particles.

The charge stability of the toner particles was determined by measuring the $Q_{T1}$ value immediately after the developer preparation and $Q_{T2}$ 1 week thereafter upon redispersing optionally precipitated toner by stirring. A small difference in $Q_T$ value points to a high charge stability per toner particle i.e. a poor ion association and low particle agglomeration.

In the present Example $Q_{T1}$:$+4.10^{-8}$ C and $Q_{T2}$:$+4.10^{-8}$ C.

The average diameter of the toner particles was about 250 nm measured with the COULTER (trade mark) NANO-SIZER. The measuring principles used in this instrument are those of Brownian motion and autocorrelation spectroscopy of scattered laser light. The frequency of this Brownian motion is inversely related to particle size.

EXAMPLE 2

1 g of copolymer D prepared according to preparation 2 was first dissolved in 250 ml of acetone and 4 g of PRINTEX G (trade name) carbon black pigment was dispersed therein. After dispersion the solvent was evaporated leaving the copolymer coated onto the pigment particles. The copolymer-coated carbon black was then redispersed in isododecane in a ball mill. The obtained dispersed toner particles were positively charged, which was proved by zeta-potential measurement ($\xi = +26.2$ mV). The average toner particle diameter was about 400 nm measured as described in Example 1.

Immediately after preparation the $Q_{T1}$ value of the developer liquid was $+3.10^{-8}$ C and after 1 week standing and re-dispersing the $Q_{T2}$ value was $+4.10^{-8}$ C.

The obtained electrophoretic toner proved to be suited for the development of negatively charged areas on commercial zinc oxide photoconductor recording material which was negatively charged to $-500$ V by corona discharge before image-wise exposure.

EXAMPLE 3

0.5 g of POLYCROWN DB-186-F, a crown-ether polymer of Parish Chemical Company, 815 West Columbia Lane, Provo, Utah; USA, having the following structural formula:

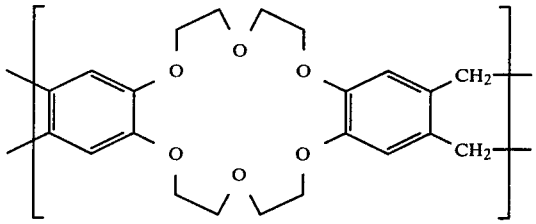

(prepared analogously to the polymer compounds disclosed in ref. 18 given hereinbefore) was first dissolved in 250 ml of chlorobenzene and 4 g of PRINTEX G (trade name) carbon black pigment was dispersed therein. After dispersion the solvent was evaporated in a rotary-evaporator leaving the crown-ether polymer coated onto the carbon black. The crown-ether coated carbon black was ball-milled for 15 h in the presence of 0.216 g of potassium iodide dissolved in 50 ml of methanol.

After the evaporation of the methanol the composition was ball-milled again in 50 ml of isododecane. The obtained dispersed toner particles were positively charged.

Immediately after preparation the $Q_{T1}$ value of the developer liquid was $+4.10^{-8}$ C and after 1 week standing and re-dispersing the $Q_{T2}$ value was $+3.5 \cdot 10^{-8}$ C.

The average toner particle size was about 200 nm.

The obtained electrophoretic toner proved to be suited for the development of negatively charged areas on commercial zinc oxide photoconductor recording material which was negatively charged to −500 V by corona discharge before image-wise exposure.

We claim:

1. A liquid electrophoretic developer composition suitable for rendering visible electrostatically charged areas, which composition contains in an electrically insulating non-polar carrier liquid having a volume resistivity of at least $10^9$ ohm.cm and a dielectric constant less than 3, dispersed colouring matter acting as toner particles and at least one polymer comprising cationic groups neutralized with counter anions, characterized in that said cationic groups are positively charged groups of metal ion containing coordination compounds.

2. Developer composition according to claim 1, characterized in that said positively charged coordination compound groups are:

(1) bidentate groups with central $Me^{2+}$, $Me^{3+}$ or $Me^{4+}$ ion, wherein Me stands for metal, (2) tridentate groups with central $Me^{2+}$, $Me^{3+}$ or $Me^{4+}$ ion, (3) glyme-groups (polyglycol dimethyl ether groups) with central metal ion, (4) crown-ether groups (macrocyclic polyether groups) with central metal ion, or (5) cryptate groups (macrobicyclic polyether groups) with central a metal ion.

3. Developer composition according to claim 1, characterized in that said positively charged groups are neutralized with halide, monomethyl sulphate or p-toluene sulphonate ion.

4. Developer composition according to claim 1, characterized in that said positively charged groups are neutralized with a polyatomic anion the negative charge of which is localized on an atom or group of atoms which is sterically embraced by at least two non-ionic hydrocarbon substituents containing at least 4 carbon atoms.

5. Developer composition according to claim 1, characterized in that said positively charged groups are neutralized with an anion which is a sterically hindered phenolate or aromatic carboxylate having as substituents at least two $C_4$–$C_{20}$ alkyl, aralkyl, cycloalkyl or aryl groups to embrace the $—O^-$ or $—COO^-$ group, or is a tetrahydrocarbon-substituted boride anion according to the following general formula:

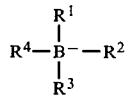

wherein:

each of $R^1$,$R^2$, $R^3$ and $R^4$ (same or different) represents a $C_4$–$C_{20}$ alkyl group, an alkenyl group, an cycloalkyl group, an aralkyl group or an aryl group.

6. Developer composition according to claim 1, characterized in that said positively charged groups are neutralized with an anion being a polyatomic anion containing a negatively charged central atom embraced by at least 4 oxygen atoms.

7. Developer composition according to claim 1, characterized in that said positively charged groups are neutralized with an anion which is a polyatomic anion containing a negatively charged central borine, arsenic, aluminium, silicon, phosphorus, tin, antimony, tantalum or bismuth atom surrounded by at least 4 fluorine atoms.

8. Developer composition according to claim 1, characterized in that said positively charged groups are neutralized with an anion which is a polyatomic anion wherein the negative charge is delocalized over an aromatic conjugated system of alternating single and double bonds by the presence thereon of one or more electron-withdrawing substituents.

9. Developer composition according to claim 1, characterized in that said positively charged groups are neutralized with an anion corresponding to the following general formula:

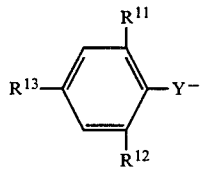

wherein:

$Y^-$ represents a $—O^-$ or $—S^-$ group, and each of $R^{11}$, $R^{12}$ and $R^{13}$ (the same or different) is $—NO_2$, halogen, —CN, $—CF_3$, or —CHO.

10. Developer composition according to claim 1, characterized in that the polymer comprising said organic cationic groups is a copolymer which contains recurring units including said positively charged groups together with recurring units of non-ionic hydrophobic solvatizing monomers.

11. Developer composition according to claim 10, characterized in that said solvatizing monomer is a non-ionic hydrophobic monomer selected from the group consisting of:

alkylstyrenes having from 3 to 10 carbon atoms in the alkyl group, alkoxystyrenes having from 3 to 10 carbon atoms in the alkyl group, alkyl acrylates and methacrylates having from 8 to 22 carbon atoms in the alkyl group, vinyl alkyl ethers having from 8 to 22 carbon atoms in the alkyl group, and vinyl esters of alkanoic acids having from 6 to 22 carbon atoms in the alkyl group.

12. Developer composition according to claim 11, characterized in that the copolymer also comprises recurring units of non-ionic substantially non-solvatizing monomers selected from the group consisting of:

(a) $\alpha,\beta$-ethylenically unsaturated carboxylic acid alkyl esters with $C_1$–$C_4$ alkyl group, (b) styrene, methylstyrene, methoxystyrene and halogenated styrene;

(c) vinyl alkyl ethers having from 1 to 4 carbon atoms in the alkyl group, and (d) vinyl esters of alkanoic acids having from 1 to 4 carbon atoms in the alkyl groups and mixtures thereof.

13. Developer composition according to claim 1, characterized in that the carrier liquid is a hydrocarbon liquid.

14. Developer composition according to claim 1, characterized in that the pigment particles are carbon black particles.

* * * * *